US007339413B2

(12) United States Patent
Kim

(10) Patent No.: US 7,339,413 B2
(45) Date of Patent: Mar. 4, 2008

(54) CLOCK GENERATOR AND ORGANIC LIGHT EMITTING DISPLAY (OLED) INCLUDING THE CLOCK GENERATOR

(75) Inventor: Tae-Gyu Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/505,876

(22) Filed: Aug. 18, 2006

(65) Prior Publication Data

US 2007/0063931 A1 Mar. 22, 2007

(30) Foreign Application Priority Data

Sep. 16, 2005 (KR) ..... 10-2005-0086681

(51) Int. Cl.
*G06F 1/04* (2006.01)

(52) U.S. Cl. ..... 327/291; 327/108

(58) Field of Classification Search ..... None
See application file for complete search history.

(56) References Cited

U.S. PATENT DOCUMENTS 5,517,142 A * 5/1996 Jang et al. ..... 327/108
5,856,918 A * 1/1999 Soneda et al. ..... 363/60
5,959,474 A * 9/1999 Park et al. ..... 327/112
6,023,182 A * 2/2000 Milshtein et al. ..... 327/299
6,118,311 A * 9/2000 Kamiya ..... 327/112
6,583,655 B2 * 6/2003 Takahashi et al. ..... 327/160
6,707,324 B1 * 3/2004 Chu ..... 327/108
6,720,807 B1 * 4/2004 Kubo et al. ..... 327/141
6,870,776 B2 * 3/2005 Kim et al. ..... 365/189.05
7,068,078 B2 * 6/2006 Yoo ..... 326/87
7,071,765 B2 * 7/2006 Kamijo ..... 327/536
7,102,416 B2 * 9/2006 Finney ..... 327/434
2003/0117185 A1 * 6/2003 Ishibashi et al. ..... 327/108

FOREIGN PATENT DOCUMENTS

KR 2003-0095272 12/2003
KR 10-2004-0089246 10/2004

* cited by examiner

*Primary Examiner*—N. Drew Richards
*Assistant Examiner*—Cassandra Cox
(74) *Attorney, Agent, or Firm*—Robert E. Bushnell, Esq.

(57) ABSTRACT

A clock generator, which can be included in an Organic Light Emitting Display (OLED), includes four switching units and two inverters. Each of the switching units includes two transistors. Transistors of two switching units that are connected to a high-level voltage line are PMOS transistors, and transistors of two switching units that are connected to a low-level voltage line are NMOS transistors. The switching units are sequentially turned on/off in response to four control signals so that the clock generator generates a clock signal. Each of the control signals has a duty ratio of 50%, and there is a phase difference of 90° between the control signals. The clock signal alternates between a low level and a high level every ¼ of a cycle of each of the control signals.

20 Claims, 4 Drawing Sheets

CLOCK GENERATOR AND ORGANIC LIGHT EMITTING DISPLAY (OLED) INCLUDING THE CLOCK GENERATOR

CLAIM OF PRIORITY

This application makes reference to, incorporates the same herein, and claims all benefits accruing under 35 U.S.C. § 119 from an application for CLOCK GENERATOR AND ORGANIC ELECTROLUMINESCENT DISPLAY DEVICE FOR HAVING THE SAME earlier filed in the Korean Intellectual Property Office on the 16 of Sep. 2005 and there duly assigned Serial No. 10-2005-0086681.

BACKGROUND OF THE INVENTION

1. Field of the Invention

The present invention relates to a clock generator and an Organic Light Emitting Display (OLED) including the clock generator, and more particularly, to a clock generator which generates clock signals at high speed without a delay time and without feedback of the clock signals, and to an OLED including the clock generator.

2. Description of the Related Art

In recent years, a high-speed serial link system has become strongly relied upon. Above all, an oscillator used for a transmission terminal and a receiving terminal is one of the most important components of the high-speed serial link system.

FIG. 1 is a circuit diagram of a clock generator. Referring to FIG. 1, the clock generator includes four transistors MP1, MP2, MN1, and MN2, n switching units 10, and an inverter 20.

The transistor MP1 is connected between a high-level voltage line VDD and a node A and is turned on/off in response to a clock signal CLK fed back to the transistor MP1.

The transistor MP2 is connected between the high-level voltage line VDD and a node N and is turned on/off according to the level of the node A. The transistors MP1 and MP2 are P-type Metal Oxide Semiconductor (PMOS) transistors, each of which is turned on in response to a low-level control signal and turned off in response to a high-level control signal.

The transistor MN1 is connected between a low-level voltage line VSS and a node B and is turned on/off in response to a clock signal CLK fed back into the transistor MN1.

The transistor MN2 is connected between the low-level voltage line VSS and the node B and is turned on/off according to the level of the node B. The transistors MN1 and MN2 are N-type Metal Oxide Semiconductor (NMOS) transistors, each of which is turned off in response to a low-level control signal and turned on in response to a high-level control signal.

The n switching units 10 are connected between the node A and the node B. The switching units 10 receive n control signals D1-DN (refer to FIG. 3) with the same delay time and perform a switching operation so that the node A is connected to or disconnected from the node B. The detailed construction of each of the switching units 10 is illustrated in FIG. 2.

FIG. 2 is a detailed circuit diagram of a switching unit of the clock generator of FIG. 1. Referring to FIG. 2, the switching unit 10 of the clock generator includes two transistors MN3 and MN4 and three inverters 21, 22, and 23.

The transistor MN3 is connected to the node A and is turned on/off in response to a first control signal D1.

The transistor MN4 is connected between the transistor MN3 and the node B and is turned on/off in response to a control signal output from the three inverters 21, 22, and 23 that are connected in series. The transistors MN3 and MN4 are NMOS transistors.

The three inverters 21, 22, and 23 that are connected in series receive the first control signal D1 and invert the first control signal D1 three times. Therefore, the first control signal D1 is not transmitted to the transistors MN3 and MN4 at the same time but rather is transmitted to the transistor MN4 after being delayed by a predetermined time due to the serially connected inverters 21, 22, and 23.

Referring to FIG. 1 again, the inverter 20 is connected between the node N and an output terminal and inverts the level of the node N.

Hereinafter, the operation of the clock generator of FIGS. 1 and 2 is described below with reference to FIG. 3.

FIG. 3 is a timing diagram of n control signals, which illustrates the operation of the clock generator of FIG. 1.

Referring to FIG. 3, the n+1 control signals D0-DN are respectively sequentially supplied to the n+1 switching units 10, with a predetermined delay time. Each of the control signals D0-DN has a duty ratio of 50% and alternates between a high level and a low level.

When a clock signal CLK is at a low level and the control signal D1 transitions to a high level, the transistor MP1 of FIG. 1 is turned on, and the transistor MN1 of FIG. 1 is turned off. Thus, a high-level voltage VDD is supplied to the node A.

Also, the transistor MN3 of the switching unit 10 shown in FIG. 2 is turned on, and the transistor MN4 is turned on for a Δ delay time and then turned off. That is, the transistor MN3 is connected to the transistor MN4 (i.e., the node A is connected to the node B) for the Δ delay time, so that the transistor MN2 is turned on in response to a high-level control signal and supplies a low-level voltage VSS to the node N. The low-level voltage VSS is inverted by the inverter 20 and becomes a high-level clock signal CLK. After an elapse of the Δ delay time, since there is no current path between the node A and the node B, no further displacement occurs.

While the n+1 control signals D0 to DN are sequentially supplied, the above-described operation is repeated to generate the clock signal CLK.

As described above with reference to FIGS. 1 through 3, the clock generator structurally uses a feedback signal loop. In this case, since the clock generator operates using an oscillator including an odd number of inverters for a time period in which the feedback signal loop is used, there is a maximum allowed Δ delay time. In addition, there is a minimum allowed time for which both the transistors MN3 and MN4 are turned on at the same time to allow sufficient operation. Furthermore, there is a minimum time taken for a feedback signal to finish a unit operation. As a result, since the clock generator uses a feedback loop, a frequency at which the clock generator outputs a clock signal is limited below 1 GHz.

SUMMARY OF THE INVENTION

The present invention, therefore, provides a clock generator, which is structurally stable and novel and generates clock signals at high speed, and an Organic Light Emitting Display (OLED) including the clock generator.

In an exemplary embodiment of the present invention, a clock generator includes: a first switching unit connected between a high-level voltage line and a clock signal output terminal, and adapted to output or cut off a high-level voltage in response to a first control signal and a second control signal; a second switching unit connected between a low-level voltage line and the clock signal output terminal and adapted to output or cut off a low-level voltage in response to the first control signal and an inverted second control signal; a third switching unit connected between the high-level voltage line and the clock signal output terminal and adapted to output or cut off the high-level voltage in response to an inverted first control signal and the inverted second control signal; and a fourth switching unit connected between the low-level voltage line and the clock signal output terminal and adapted to output or cut off the low-level voltage in response to the inverted first control signal and the second control signal; the first and second control signals each have a duty ratio of 50% and have a phase difference of 90° therebetween.

In another exemplary embodiment of the present invention, an organic light emitting display device (OLED) includes: a display panel having a plurality of pixels arranged in regions where a plurality of data lines intersect a plurality of scan lines, and adapted to display a predetermined image; a scan driver connected to the scan lines and adapted to sequentially supply scan signals to the scan lines; a data driver connected to the data lines and adapted to sequentially supply data signals to the data lines; and a clock generator adapted to supply clock signals to the scan driver and the data driver; the clock generator includes: a first switching unit connected between a high-level voltage line and a clock signal output terminal, and adapted to output or cut off a high-level voltage in response to a first control signal and a second control signal; a second switching unit connected between a low-level voltage line and the clock signal output terminal and adapted to output or cut off a low-level voltage in response to the first control signal and an inverted second control signal; a third switching unit connected between the high-level voltage line and the clock signal output terminal and adapted to output or cut off the high-level voltage in response to an inverted first control signal and the inverted second control signal; and a fourth switching unit connected between the low-level voltage line and the clock signal output terminal and adapted to output or cut off the low-level voltage in response to the inverted first control signal and the second control signal; the first and second control signals each have a duty ratio of 50% and have a phase difference of 90° therebetween.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully hereinafter with reference to the accompanying drawings, in which exemplary embodiments of the present invention are shown.

Figure 4:
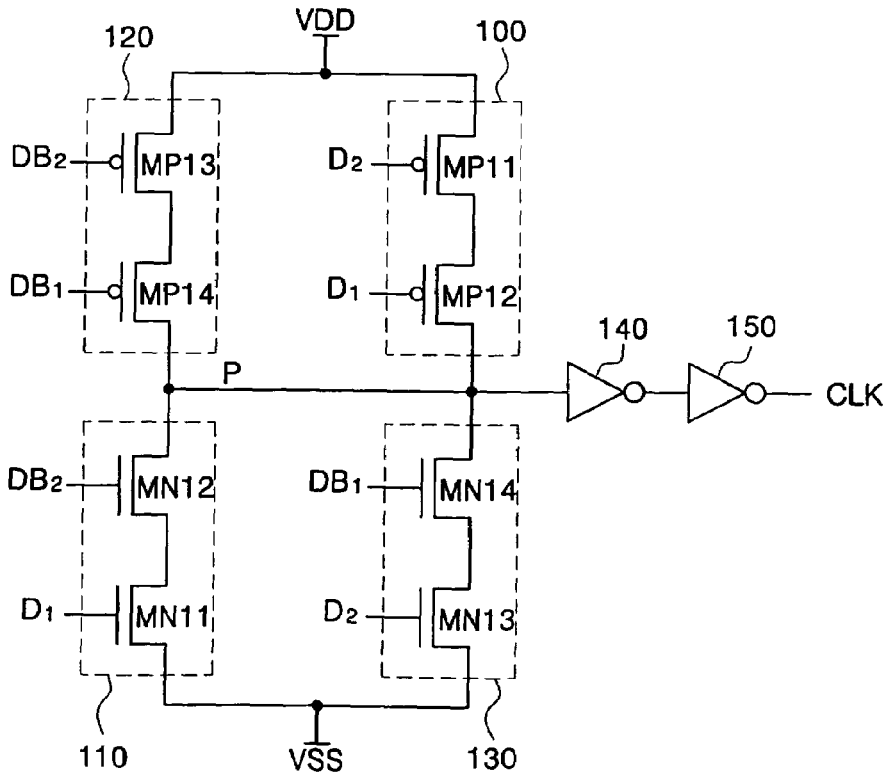
FIG. 4 is a circuit diagram of a clock generator according to an embodiment of the present invention.

FIG. 4 is a circuit diagram of a clock generator according to an embodiment of the present invention. Referring to FIG. 4, the clock generator according to the embodiment of the present invention includes four switching units 100, 110, 120, and 130 and two inverters 140 and 150.

A first switching unit 100 is connected between a high-level voltage line VDD and a node P and receives a first control signal D1 and a second control signal D2. Thus, the first switching unit 100 outputs or cuts off a high-level voltage VDD in response to the first and second control signals D1 and D2.

Specifically, the first switching unit 100 includes a first transistor MP11 and a second transistor MP12. The first transistor MP11 is connected to the high-level voltage line VDD and turned on/off in response to the second control signal D2. The second transistor MP12 is connected between the first transistor MP11 and the node P and turned on/off in response to the first control signal D1. Also, the first and second transistors MP11 and MP12 are PMOS transistors. When both the first and second control signals D1 and D2 are at a low level, the first switching unit 100 is turned on and outputs a high-level voltage VDD.

In the clock generator according to the embodiment of the present invention, each of the first and second control signals D1 and D2 has a duty ratio of 50% as will be described later with reference to FIG. 5, and there is a phase difference of 90° between the first and second control signals D1 and D2.

A second switching unit 110 is connected between a low-level voltage line VSS and the node P and receives the first control signal D1 and an inverted second control signal DB2. Thus, the second switching unit 110 outputs the low-level voltage VSS or cut off in response to the first control signal D1 and the inverted second control signal DB2.

Specifically, the second switching unit 110 includes a third transistor MN11 and a fourth transistor MN12. The third transistor MN11 is connected to the low-level voltage line VSS and turned on/off in response to the first control signal D1. The fourth transistor MN12 is connected between the third transistor MN11 and the node P and turned on/off in response to the inverted second control signal DB2. Also, the third and fourth transistors MN11 and MN12 are NMOS transistors. When both the first control signal D1 and the inverted second control signal DB2 are at a high level, the second switching unit 110 is turned on and outputs the low-level voltage VSS.

A third switching unit 120 is connected between the high-level voltage line VDD and the node P and receives an inverted first control signal DB1 and the inverted second control signal DB2. Thus, the third switching unit 120 outputs the high-level voltage VDD or cut off in response to the inverted first and second control signals DB1 and DB2.

Specifically, the third switching unit 130 includes a fifth transistor MP13 and a sixth transistor MP14. The fifth transistor MP13 is connected to the high-level voltage line VDD and turned on/off in response to the inverted second control signal DB2. The sixth transistor MP14 is connected between the fifth transistor MP13 and the node P and turned on/off in response to the inverted first control signal DB1. Also, the fifth and sixth transistors MP13 and MP14 are PMOS transistors. When both the inverted first and second control signals DB1 and DB2 are at a low level, the third switching unit 110 is turned on and outputs the high-level voltage VDD.

A fourth switching unit 130 is connected between the low-level voltage line VSS and the node P and receives the inverted first control signal DB1 and the second control signal D2. Thus, the fourth switching unit 130 outputs the low-level voltage VSS or cut off in response to the inverted first control signal DB1 and the second control signal D2.

Specifically, the fourth switching unit 130 includes a seventh transistor MN13 and an eighth transistor MN14. The seventh transistor MN13 is connected to the low-level voltage line VSS and turned on/off in response to the second control signal D2. The eighth transistor MN14 is connected between the seventh transistor MN13 and the node P and turned on/off in response to the inverted first control signal DB1. Also, the seventh and eighth transistors MN13 and MN14 are NMOS transistors. When both the second control signal D2 and the inverted first control signal DB1 are at a high level, the fourth switching unit 130 is turned on and outputs the low-level voltage VSS.

A first inverter 140, which is connected to the node P, receives and inverts a signal output from the node P. Also, a second inverter 150, which is connected to the first inverter 140, receives and inverts a signal output from the first inverter 140. As a result, a clock signal output from the node P is output as is through the two inverters 140 and 150.

Figure 1:
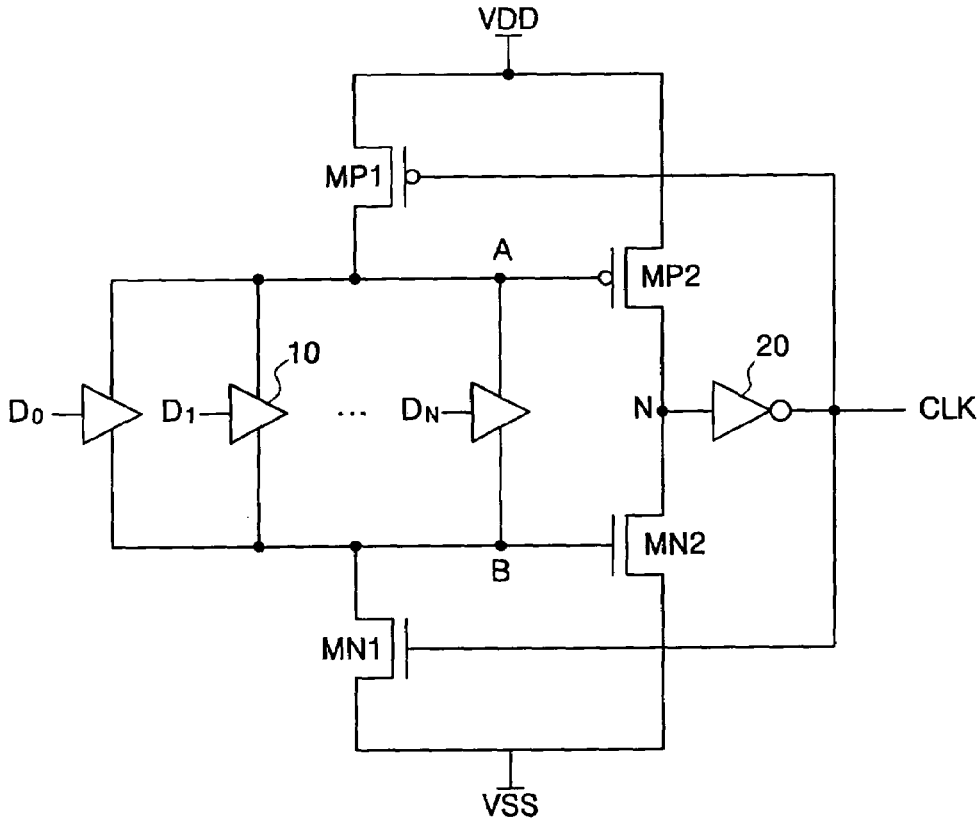
FIG. 1 is a circuit diagram of a conventional clock generator.
Figure 2:
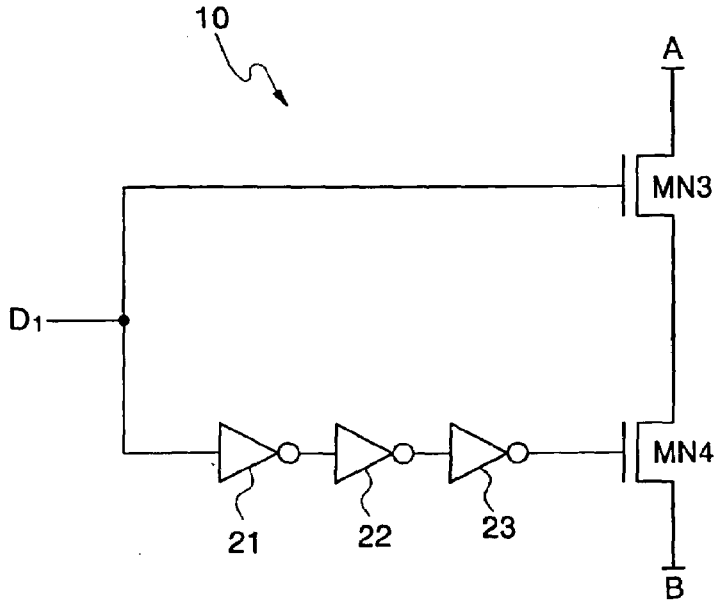
FIG. 2 is a detailed circuit diagram of a switching unit of the conventional clock generator shown in FIG. 1.
Figure 3:
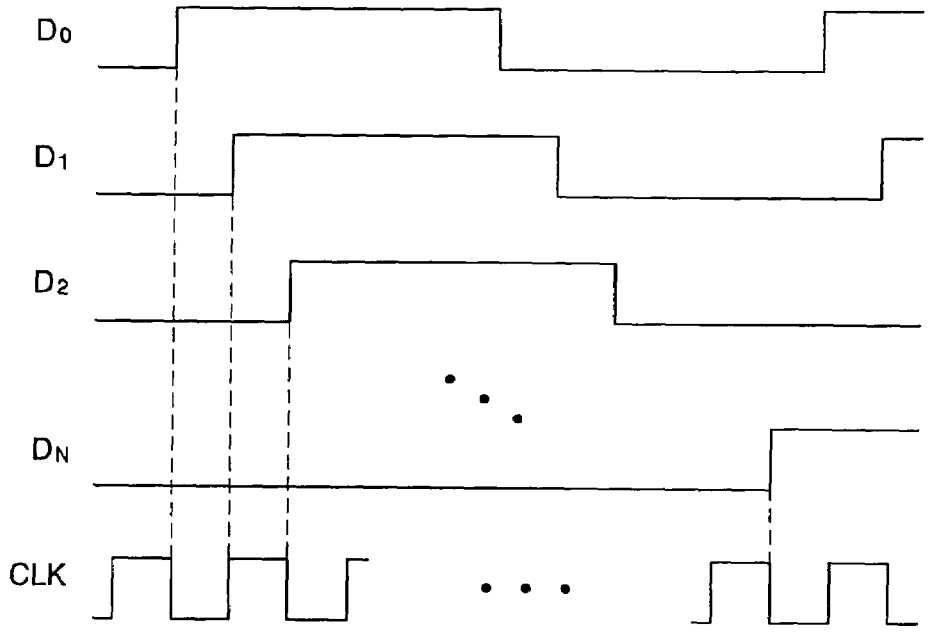
FIG. 3 is a timing diagram of n control signals, which illustrates the operation of the conventional clock generator shown in FIG. 1.

Accordingly, unlike the clock generator of FIG. 1, the clock generator according to the embodiment of the present invention does not cause a Δ delay time nor use a feedback loop. Thus, the clock generator according to the embodiment of the present invention does not require the minimum time for securing operational stability and takes no time to feed back signals. Therefore, the clock generator according to the embodiment of the present invention can generate clock signals at a high frequency of 3.5 Ghz.

Figure 5:
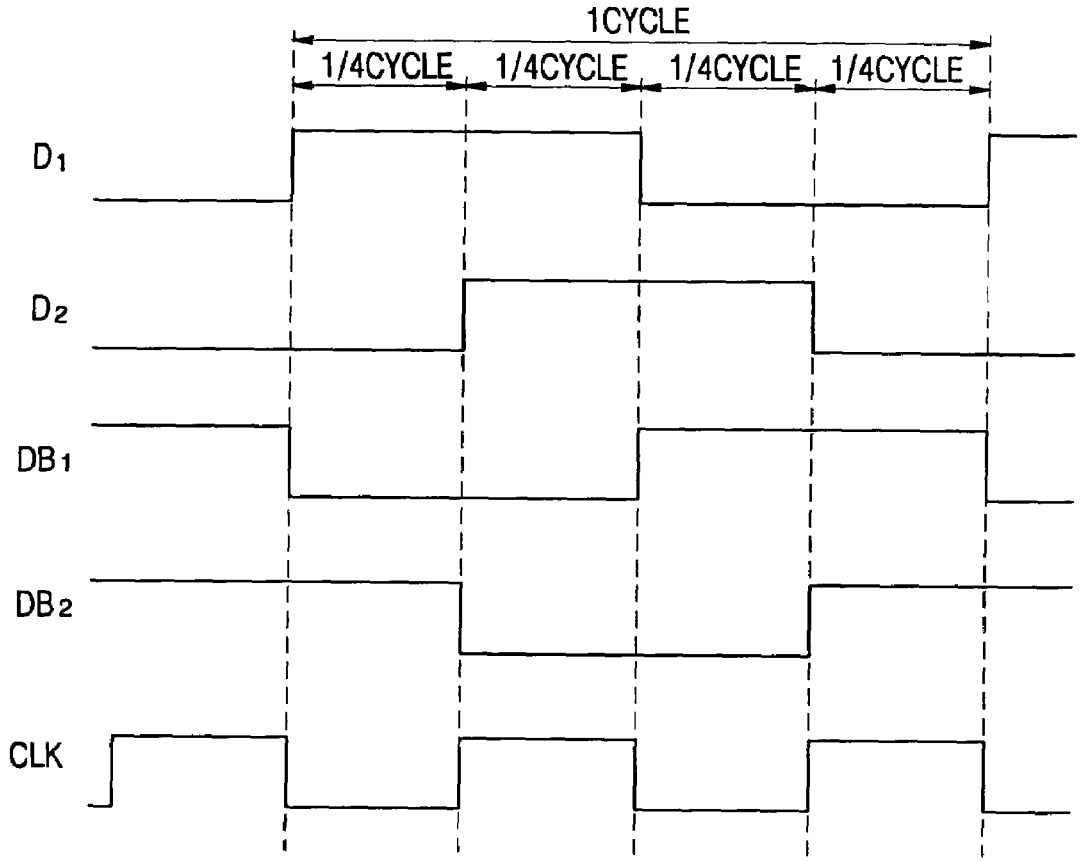
FIG. 5 is a timing diagram of signals for driving the clock generator of FIG. 4.

The operation of the clock generator of FIG. 5 is described below with reference to FIG. 5. FIG. 5 is a timing diagram of signals for driving the clock generator of FIG. 4.

Referring to FIG. 5, a first control signal D1 alternates between a high level and a low level at a duty ratio of 50%. A second control signal D2 also has a duty ratio of 50%, but there is a phase difference of 90° between the first and second control signals D1 and D2. That is, the second control signal D2 transitions to a high level ¼ of a cycle later than the first control signal D1 and alternates between a high level and a low level. An inverted first control signal DB1 is a phase-inverted version of the first control signal D1, and an inverted second control signal DB2 is a phase-inverted version of the second control signal D2.

The clock generator according to the embodiment of the present invention receives the control signals D1, D2, DB1, and DB2 having the timing as shown in FIG. 5 and alternately outputs a low-level voltage VSS and a high-level voltage VDD every ¼ cycle. The operation of the clock generator according to the levels of the control signals D1, D2, DB1, and DB2 is described below.

First, for the first ¼ cycle, when the clock generator receives a high-level first control signal D1 and a low-level second control signal D2, the first switching unit 100, the third switching unit 120, and the fourth switching unit 130 are turned off, and only the second switching unit 110 is turned on, so that the clock generator outputs a clock signal CLK having a low-level voltage VSS.

Next, for the second ¼ cycle, when the clock generator receives a high-level first control signal D1 and a high-level second control signal D2, the first switching unit 100, the second switching unit 110, and the fourth switching unit 130 are turned off, and only the third switching unit 120 is turned on, so that the clock generator outputs a clock signal CLK having a high-level voltage VDD.

Next, for the third ¼ cycle, when the clock generator receives a low-level first control signal D1 and a high-level second control signal D2, the first switching unit 100, the second switching unit 110, and the third switching unit 120 are turned off, and only the fourth switching unit 130 is turned on, so that the clock generator outputs a clock signal CLK having a low-level voltage VSS.

Finally, for the fourth ¼ cycle, when the clock generator receives a low-level first clock signal D1 and a low-level second control signal D2, the second switching unit 110, the third switching unit 120, and the fourth switching unit 130 are turned off, and only the first switching unit 100 is turned on, so that the clock generator outputs a clock signal CLK having a low-level voltage VSS.

The clock generator repeatedly receives the control signals D1, D2, DB1, and DB2 having the timing as shown in FIG. 5 and repeatedly performs the above-described one-cycle operation to output the clock signal CLK.

Unlike the clock generator of FIG. 1, since the clock generator according to the embodiment of the present invention does not cause a delay time nor use a feedback loop, clock signals CLK can be generated at a very high frequency of about 3.5 GHz or less.

Figure 6:
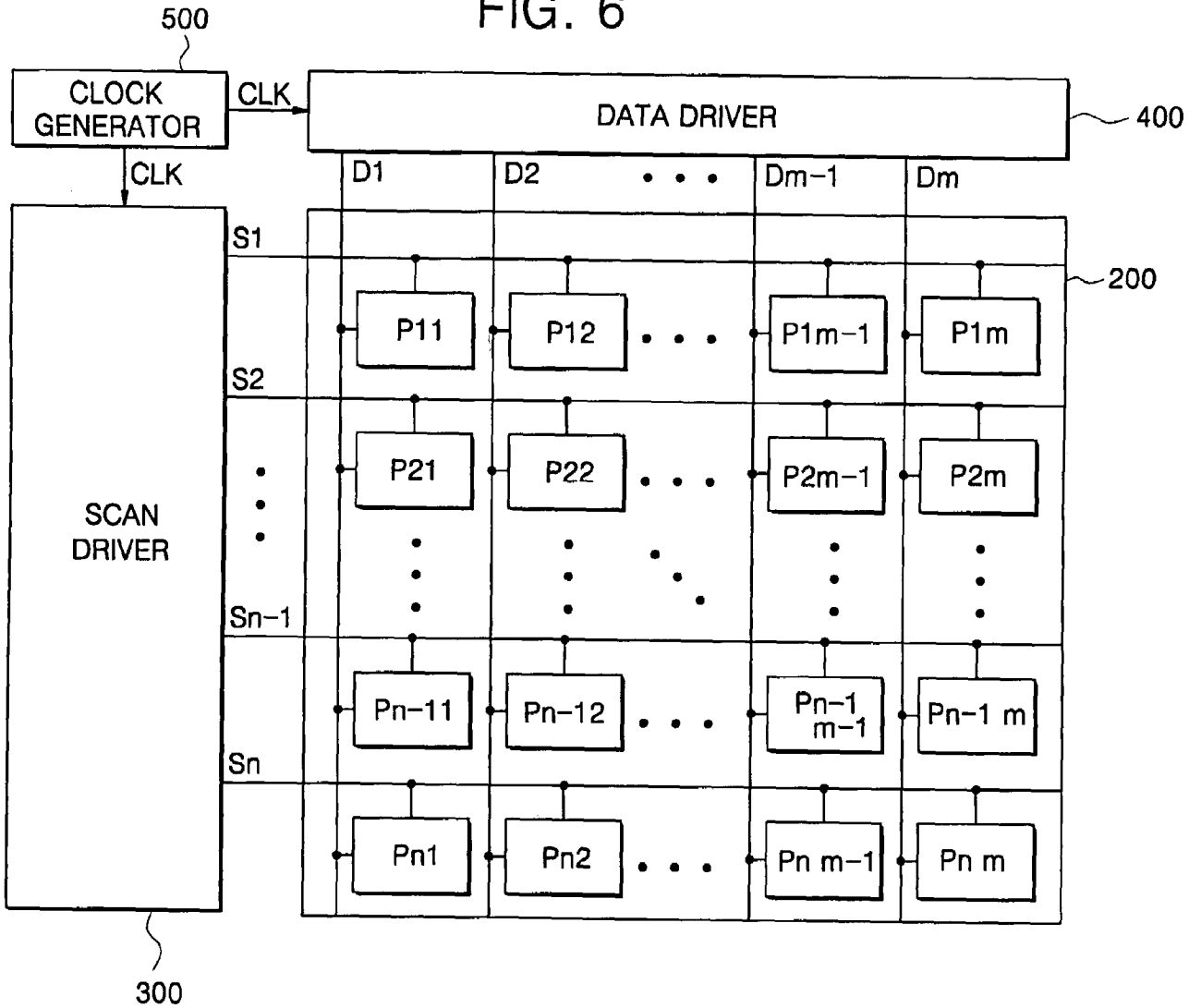
FIG. 6 is a block diagram of an Organic Light Emitting Display (OLED) having a clock generator according to an embodiment of the present invention.

FIG. 6 is a block diagram of an Organic Light Emitting Display (OLED) having a clock generator according to an embodiment of the present invention. Referring to FIG. 6, the OLED having the clock generator according to the embodiment of the present invention includes a display panel 200, a scan driver 300, a data driver 400, and a clock generator 500.

In the display panel 200, a plurality of scan lines S1 to Sn and a plurality of data lines D1 to Dm are arranged in rows and columns. Pixels P11 to Pnm, which emit light with a predetermined luminance, are formed in regions where the scan lines S1 to Sn intersect the data lines D1 to Dm.

Each of the pixels P1 to Pnm includes a pixel driver (not shown) and an organic light emitting diode. The pixel driver is connected to the scan line and the data line. The organic light emitting diode receives a driving current from the pixel driver and emits light with a predetermined luminance according to the amount of the driving current. The pixel driver includes a plurality of Thin Film Transistors (TFTs) and generates a driving current corresponding to a data signal.

The scan driver 300 is connected to the scan lines S1 to Sn and supplies scan signals to the respective scan lines S1 to Sn. Also, the data driver 400 is connected to the data lines D1 to Dm and supplies data signals to the respective data lines D1 to Dm.

The clock generator 500 supplies clock signals CLK to the scan driver 300 and the data driver 400. The scan driver 300 and the data driver 400 make use of a shift register (not shown) to transmit the scan signals and the data signals. The shift register is turned on/off in response to a clock signal CLK generated by the clock generator 500 and transmits the scan signals and the data signals. Since a high-resolution large-sized display panel should transmit many signals in a short amount of time, a speed at which the clock signal CLK is generated should be increased to improve the operating speed of the display panel. Accordingly, since the OLED can be improved in operating speed by using the clock generator 500 according to the embodiment of the present invention, a high-resolution large-sized display panel can be designed.

According to the present invention as described above, a clock generator does not cause a delay time nor use a feedback loop. Thus, the clock generator does not require the minimum delay time for securing operational stability and takes no time to feed back signals. As a result, the clock generator can generate clock signals at very high speed.

Although the present invention has been described with reference to certain exemplary embodiments thereof, it will be understood by those skilled in the art that a variety of modifications and variations can be made to the present invention without departing from the spirit or scope of the present invention as defined by the appended claims.

What is claimed is:

1. A clock generator, comprising:

a first switching unit connected between a high-level voltage line and a clock signal output terminal, and adapted to output or cut off a high-level voltage in response to a first control signal and a second control signal;

a second switching unit connected between a low-level voltage line and the clock signal output terminal and adapted to output or cut off a low-level voltage in response to the first control signal and an inverted second control signal;

a third switching unit connected between the high-level voltage line and the clock signal output terminal and adapted to output or cut off the high-level voltage in response to an inverted first control signal and the inverted second control signal; and a fourth switching unit connected between the low-level voltage line and the clock signal output terminal and adapted to output or cut off the low-level voltage in response to the inverted first control signal and the second control signal;

wherein the first and second control signals each have a duty ratio of 50% and have a phase difference of 90° therebetween.

2. The clock generator according to claim 1, wherein the first switching unit comprises:

a first transistor connected to the high-level voltage line and adapted to be turned on/off in response to the second control signal; and a second transistor connected between the first transistor and the clock signal output terminal and adapted to be turned on/off in response to the first control signal.

3. The clock generator according to claim 2, wherein the first and second transistors comprise PMOS transistors, and wherein the first switching unit is adapted to be turned on and to output the high-level voltage in response to the first and second control signals being at a low level.

4. The clock generator according to claim 1, wherein the second switching unit comprises:

a third transistor connected to the low-level voltage line and adapted to be turned on/off in response to the first control signal; and a fourth transistor connected between the third transistor and the clock signal output terminal and adapted to be turned on/off in response to the inverted second control signal.

5. The clock generator according to claim 4, wherein the third and fourth transistors comprise NMOS transistors, and wherein the second switching unit is adapted to be turned on and to output the low-level voltage in response to the first control signal and the inverted second control signal being at a high level.

6. The clock generator according to claim 1, wherein the third switching unit comprises:

a fifth transistor connected to the high-level voltage line and adapted to be turned on/off in response to the inverted second control signal; and a sixth transistor connected between the fifth transistor and the clock signal output terminal and adapted to be turned on/off in response to the inverted first control signal.

7. The clock generator according to claim 6, wherein the fifth and sixth transistors comprise PMOS transistors, and wherein the third switching unit is adapted to be turned on and to output the high-level voltage in response to the inverted first and second control signals being at a low level.

8. The clock generator according to claim 1, wherein the fourth switching unit comprises:

a seventh transistor connected to the low-level voltage line and adapted to be turned on/off in response to the second control signal; and an eighth transistor connected between the seventh transistor and the clock signal output terminal and adapted to be turned on/off in response to the inverted first control signal.

9. The clock generator according to claim 8, wherein the seventh and eighth transistors comprise NMOS transistors, and wherein the fourth switching unit is adapted to be turned on and to output the low-level voltage in response to the inverted first control signal and the second control signal being at a high level.

10. The clock generator according to claim 1, further comprising:

a first inverter connected to the clock signal output terminal and adapted to invert the clock signal; and a second inverter connected to the first inverter and adapted to invert the inverted clock signal.

11. An organic light emitting display device (OLED), comprising:

a display panel having a plurality of pixels arranged in regions where a plurality of data lines intersect a plurality of scan lines, and adapted to display a predetermined image;

a scan driver connected to the scan lines and adapted to sequentially supply scan signals to the scan lines;

a data driver connected to the data lines and adapted to sequentially supply data signals to the data lines; and a clock generator adapted to supply clock signals to the scan driver and the data driver;

wherein the clock generator comprises:

a first switching unit connected between a high-level voltage line and a clock signal output terminal, and adapted to output or cut off a high-level voltage in response to a first control signal and a second control signal;

a second switching unit connected between a low-level voltage line and the clock signal output terminal and adapted to output or cut off a low-level voltage in response to the first control signal and an inverted second control signal;

a third switching unit connected between the high-level voltage line and the clock signal output terminal and adapted to output or cut off the high-level voltage in response to an inverted first control signal and the inverted second control signal; and a fourth switching unit connected between the low-level voltage line and the clock signal output terminal and adapted to output or cut off the low-level voltage in response to the inverted first control signal and the second control signal;

wherein the first and second control signals each have a duty ratio of 50% and have a phase difference of 90° therebetween.

12. The OLED according to claim 11, wherein the first switching unit comprises:

a first transistor connected to the high-level voltage line and adapted to be turned on/off in response to the second control signal; and a second transistor connected between the first transistor and the clock signal output terminal and adapted to be turned on/off in response to the first control signal.

13. The OLED according to claim 12, wherein the first and second transistors comprise PMOS transistors, and wherein the first switching unit is adapted to be turned on and to output the high-level voltage in response to the first and second control signals being at a low level.

14. The OLED according to claim 11, wherein the second switching unit comprises:

a third transistor connected to the low-level voltage line and adapted to be turned on/off in response to the first control signal; and a fourth transistor connected between the third transistor and the clock signal output terminal and adapted to be turned on/off in response to the inverted second control signal.

15. The OLED according to claim 14, wherein the third and fourth transistors comprise NMOS transistors, and wherein the second switching unit is adapted to be turned on and to output the low-level voltage in response to the first control signal and the inverted second control signal being at a high level.

16. The OLED according to claim 11, wherein the third switching unit comprises:

a fifth transistor connected to the high-level voltage line and adapted to be turned on/off in response to the inverted second control signal; and a sixth transistor connected between the fifth transistor and the clock signal output terminal and adapted to be turned on/off in response to the inverted first control signal.

17. The OLED according to claim 16, wherein the fifth and sixth transistors comprise PMOS transistors, and wherein the third switching unit is adapted to be turned on and to output the high-level voltage in response to the inverted first and second control signals being at a low level.

18. The OLED according to claim 11, wherein the fourth switching unit comprises:

a seventh transistor connected to the low-level voltage line and adapted to be turned on/off in response to the second control signal; and an eighth transistor connected between the seventh transistor and the clock signal output terminal and adapted to be turned on/off in response to the inverted first control signal.

19. The OLED according to claim 18, wherein the seventh and eighth transistors comprise NMOS transistors, and wherein the fourth switching unit is adapted to be turned on and to output the low-level voltage in response to the inverted first control signal and the second control signal being at a high level.

20. The OLED according to claim 11, wherein the clock generator further comprises:

a first inverter connected to the clock signal output terminal and adapted to invert the clock signal; and a second inverter connected to the first inverter and adapted to invert the inverted clock signal.

* * * * *